US012371139B2

(12) United States Patent
Hirao

(10) Patent No.: US 12,371,139 B2
(45) Date of Patent: Jul. 29, 2025

(54) CONTROL APPARATUS AND CONTROL METHOD FOR OUTBOARD MOTOR

(71) Applicant: HONDA MOTOR CO., LTD., Tokyo (JP)

(72) Inventor: Shunichi Hirao, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 299 days.

(21) Appl. No.: 17/994,607

(22) Filed: Nov. 28, 2022

(65) Prior Publication Data

US 2023/0202632 A1 Jun. 29, 2023

(30) Foreign Application Priority Data

Dec. 28, 2021 (JP) ..... 2021-215073

(51) Int. Cl.
*B63H 20/12* (2006.01)
*B63H 25/42* (2006.01)
*B63H 20/00* (2006.01)

(52) U.S. Cl.
CPC ..... *B63H 20/12* (2013.01); *B63H 25/42* (2013.01); *B63H 2020/003* (2013.01)

(58) Field of Classification Search
CPC ... B63H 20/12; B63H 25/42; B63H 2020/003
USPC ..... 701/21
See application file for complete search history.

(56) References Cited

U.S. PATENT DOCUMENTS

| | | | | |
|---|---|---|---|---|
| 7,510,449 | B2 | 3/2009 | Ito et al. | |
| 8,700,238 | B2 * | 4/2014 | Hiramatsu | B63H 25/02 114/144 R |
| 9,079,651 | B2 * | 7/2015 | Nose | B63H 20/12 |
| 10,766,589 | B1 * | 9/2020 | Ito | G05D 1/0206 |
| 2008/0115712 | A1 * | 5/2008 | Hiroshima | B63H 21/213 114/144 RE |
| 2008/0119096 | A1 | 5/2008 | Ito et al. | |
| 2011/0166724 | A1 * | 7/2011 | Hiramatsu | B63H 25/42 702/85 |
| 2014/0106631 | A1 * | 4/2014 | Ito | B63H 25/42 440/1 |
| 2017/0255205 | A1 * | 9/2017 | Hashizume | G05D 1/0875 |

(Continued)

FOREIGN PATENT DOCUMENTS

| | | | | |
|---|---|---|---|---|
| EP | 2210810 | A2 * | 7/2010 | B63H 20/12 |
| EP | 2907741 | A1 * | 8/2015 | B63H 20/12 |
| JP | 2008-128138 | A | 6/2008 | |

*Primary Examiner* — Muhammad Shafi
(74) *Attorney, Agent, or Firm* — Thomas Horstemeyer, LLP

(57) ABSTRACT

A control apparatus for a plurality of outboard motors 4, 5 spaced apart at predetermined intervals in a width direction of a hull 2, comprises a first steering unit 26 that adjusts a steering angle of the first outboard motor 4, a second steering unit 26 that adjusts a steering angle of the second outboard motor 5, and a control unit 30, 40 that controls the first steering unit and the second steering unit such that the hull moves or turns in a direction in accordance with a steering instruction of an operator by differentiating the control of the steering angle of the first outboard motor from the control of the steering angle of the second outboard motor when propulsion of either the first outboard motor or the second outboard motor cannot be obtained.

8 Claims, 6 Drawing Sheets

(56) References Cited

U.S. PATENT DOCUMENTS

| | | | | |
|---|---|---|---|---|
| 2021/0294329 | A1* | 9/2021 | Afman | G08G 3/00 |
| 2023/0150637 | A1* | 5/2023 | Afman | G05G 9/047 701/21 |

* cited by examiner

CONTROL APPARATUS AND CONTROL METHOD FOR OUTBOARD MOTOR

CROSS-REFERENCE TO RELATED APPLICATION(S)

This application claims priority to and the benefit of Japanese Patent Application No. 2021-215073 filed on Dec. 28, 2021, the entire disclosure of which is incorporated herein by reference.

BACKGROUND OF THE INVENTION

Field of the Invention

The present invention relates to a control apparatus and a control method for an outboard motor.

Description of the Related Art

Japanese Patent Laid-Open No. 2008-128138 describes a method of operating a non-faulty outboard motor on a vessel including three or more outboard motors, one of which has failed.

In a vessel including two outboard motors, for example, if one of the two outboard motors fails and no propulsion is obtained, the hull cannot travel or turn in the desired direction even if the steering operation is performed as in normal operation without failure, and thus a different steering control than in the normal condition is required.

SUMMARY OF THE INVENTION

The present invention has been made in consideration of the above described backgrounds and realizes techniques that allow a hull to travel or turn in the desired direction even when one of a plurality of outboard motors fails, as in normal operation without failure.

In order to solve the above described backgrounds, according to the first aspect of the present invention, there is provided a control apparatus for a plurality of outboard motors (4, 5) spaced apart at predetermined intervals in a width direction of a hull (2), comprising: a first steering unit (26) that adjusts a steering angle of the first outboard motor (4); a second steering unit (26) that adjusts a steering angle of the second outboard motor (5); and a control unit (30, 40) that controls the first steering unit (26) and the second steering unit (26) such that the hull (2) moves or turns in a direction in accordance with a steering instruction of an operator by differentiating the control of the steering angle of the first outboard motor (4) from the control of the steering angle of the second outboard motor (5) when propulsion of either the first outboard motor (4) or the second outboard motor (5) cannot be obtained.

According to the second aspect of the present invention, in the first aspect, the control unit (30, 40) controls the first steering unit (26) and the second steering unit (26) using the steering angle of the first outboard motor (4) and the steering angle of the second outboard motor (5), at which the hull 2 moves straight ahead, as neutral positions (θ1, θ2).

According to the third aspect of the present invention, in the second aspect, when the propulsion of the first outboard motor (4) cannot be obtained, the control unit (30, 40) sets the neutral position (θ1) of the steering angle of the second outboard motor (5) to the straight ahead direction, and sets the neutral position (θ2) of the steering angle of the first outboard motor (4) to the direction of turning opposite to the position of the first outboard motor (4).

According to the fourth aspect of the present invention, in the third aspect, when the hull (2) cannot be corrected to move straight ahead simply by changing the neutral position (θ1) of the first outboard motor (4), the control unit (30, 40) sets the neutral position (θ1) of the second outboard motor (5) at a steering angle such that the second outboard motor (5) turns in the opposite direction to the position of the first outboard motor (4).

According to the fifth aspect of the present invention, in the third or fourth aspect, the control unit (30, 40) controls the propulsion of the second outboard motor (5), and controls the propulsion of the second outboard motor (5) when an attitude of the hull (2) cannot be controlled simply by setting the steering angle of the first outboard motor (4) and the steering angle of the second outboard motor (5).

According to the sixth aspect of the present invention, in the first aspect, when at least one outboard motor fails while two or more outboard motors are disposed on the left and right sides in the width direction of the hull 2, the control unit (30, 40) sets the steering angle of all outboard motors including the at least one faulty outboard motor according to a balance of propulsion of the non-faulty outboard motors.

According to the seventh aspect of the present invention, in the sixth aspect, the control unit (30, 40) controls the propulsion of the non-faulty outboard motors in addition to the steering angle of all outboard motors including the at least one faulty outboard motor, according to the balance of propulsion of the non-faulty outboard motors.

According to the eighth aspect of the present invention, there is provided a method of controlling a plurality of outboard motors (4, 5) spaced apart at predetermined intervals in a width direction of a hull (2), wherein the plurality of outboard motors (4, 5) include a first outboard motor (4) and a second outboard motor (5), the method comprising: controlling a first steering unit (26) that adjusts the steering angle of the first outboard motor (4) and a second steering unit (26) that adjusts the steering angle of the second outboard motor (5) such that the hull (2) moves or turns in a direction in accordance with a steering instruction of an operator by differentiating the control of the steering angle of the first outboard motor (4) from the control of the steering angle of the second outboard motor (5) when the propulsion of either the first outboard motor (4) or the second outboard motor (5) cannot be obtained.

According to the present invention, even if one of the plurality of outboard motors fails, the hull can be still moved or turned in the desired direction as in normal operation without failure.

In detail, according to first to eighth aspects of the present invention, when either a first outboard motor 4 or a second outboard motor 5 fails, the operator can make a hull 2 move or turn in the desired direction simply by performing the same steering operations as in normal operation, by using the faulty outboard motor for auxiliary steering.

According to a second aspect of the present invention, the steering angle of the first outboard motor 4 and the steering angle of the second outboard motor 5 are controlled using the steering angle of the first outboard motor 4 and the steering angle of the second outboard motor 5 at which the hull 2 moves straight ahead as the neutral positions θ1 and θ2. This allows steering control based on the corrected neutral position θ2 by correcting the neutral position θ1 of the steering angle of the faulty outboard motor so that the hull 2 moves straight ahead.

According to a third aspect of the present invention, when the propulsion of the first outboard motor 4 cannot be obtained, the steering angle of the second outboard motor 5 is set to the neutral position θ1 in the straight ahead direction and the steering angle of the first outboard motor 4 is set to the neutral position in the direction of turning opposite to the position of the first outboard motor 4. This allows the hull 2 to move or turn in the desired direction by correcting the neutral position θ1 of the steering angle of the faulty first outboard motor 4 so that the hull 2 moves straight ahead, and controlling the steering angle of the first outboard motor 4 with respect to the corrected neutral position θ2.

According to a fourth aspect of the present invention, when the hull 2 cannot be corrected to move straight ahead simply by changing the neutral position θ1 of the faulty first outboard motor 4, the neutral position θ1 of the non-faulty second outboard motor 5 is set at a steering angle such that it turns in the opposite direction to the position of the first outboard motor 4. This allows the hull 2 to move or turn in the desired direction by correcting the neutral position θ1 of the steering angle of the faulty first outboard motor 4 and the non-faulty second outboard motor 5 so that the hull 2 moves straight ahead, and controlling the steering angle of the first outboard motor 4 and the second outboard motor 5 with respect to the corrected neutral position θ2.

According to a fifth aspect of the present invention, when the attitude of the hull 2 cannot be controlled simply by setting the steering angle of the faulty first outboard motor 4 and the steering angle of the non-faulty second outboard motor 5, the propulsion of the non-faulty second outboard motor 5 is controlled. This allows the hull 2 to move or turn in the desired direction.

According to sixth and seventh aspects of the present invention, when at least one outboard motor fails while two or more outboard motors are disposed on the left and right sides in the width direction of the hull 2, the main ECU 31 sets the steering angle of all outboard motors including the faulty outboard motor according to the balance of the propulsion of the non-faulty outboard motors.

Furthermore, the main ECU 31 controls the propulsion of the non-faulty outboard motors in addition to the steering angle of all outboard motors, including the faulty outboard motor according to the balance of the propulsion of the non-faulty outboard motors.

This allows the operator to move or turn the hull 2 in the desired direction simply by performing the same steering operation as under normal conditions, even if at least one outboard motor fails while two or more outboard motors are disposed on the left and right sides of the hull 2 in the width direction.

Further features of the present invention will become apparent from the following description of exemplary embodiments (with reference to the attached drawings).

DESCRIPTION OF THE EMBODIMENTS

Figure 1:
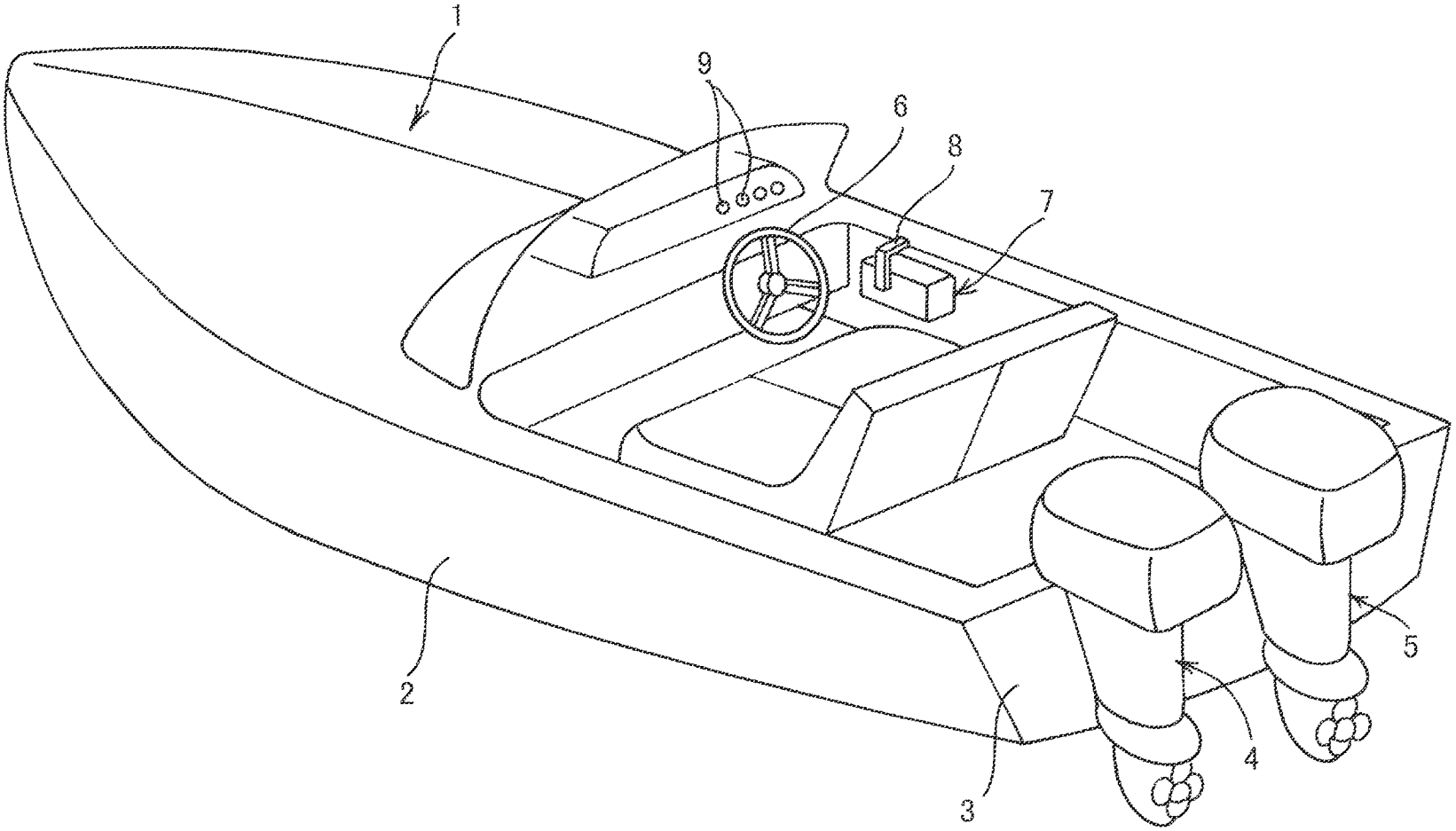
FIG. 1 is a perspective view of the exterior configuration of a vessel according to the present embodiment.

Hereinafter, embodiments will be described in detail with reference to the attached drawings. Note that the following embodiments are not intended to limit the scope of the claimed invention, and limitation is not made an invention that requires all combinations of features described in the embodiments. Two or more of the multiple features described in the embodiments may be combined as appropriate. Furthermore, the same reference numerals are given to the same or similar configurations, and redundant description thereof is omitted.

[External Appearance and Configuration of Vessel 1]

FIG. 1 is a perspective view of the external appearance and configuration of the vessel to which the control apparatus for the outboard motors of the present embodiment are applied.

As illustrated in FIG. 1, the vessel 1 includes a plurality of (for example, two) outboard motors (a first outboard motor 4 and a second outboard motor 5). The first outboard motor 4 and the second outboard motor 5 are mounted on a stern 3 of a hull 2. The first outboard motor 4 and the second outboard motor 5 are spaced apart by a predetermined distance in the width direction of the stern 3. The first outboard motor 4 is disposed on the port side of the stern 3. The second outboard motor 5 is disposed on the starboard side of the stern 3. The first outboard motor 4 and the second outboard motor 5 generate a propulsion to propel the hull 2.

A steering apparatus 6, a remote controller 7, and instruments 9 are provided near the steering seat of the hull 2. The steering apparatus 6 includes a steering wheel that allows the operator to control the turning direction of the hull 2. The remote controller 7 includes a shift lever 8 that allows the operator to adjust the speed of the hull 2 and switch between forward and backward movement of the hull 2. The instruments 9 include indicators that display the position, speed, and others of the vessel 1, and alarms that report abnormalities.

[External Appearance and Configuration of Outboard Motor 4, 5]

Figure 2:
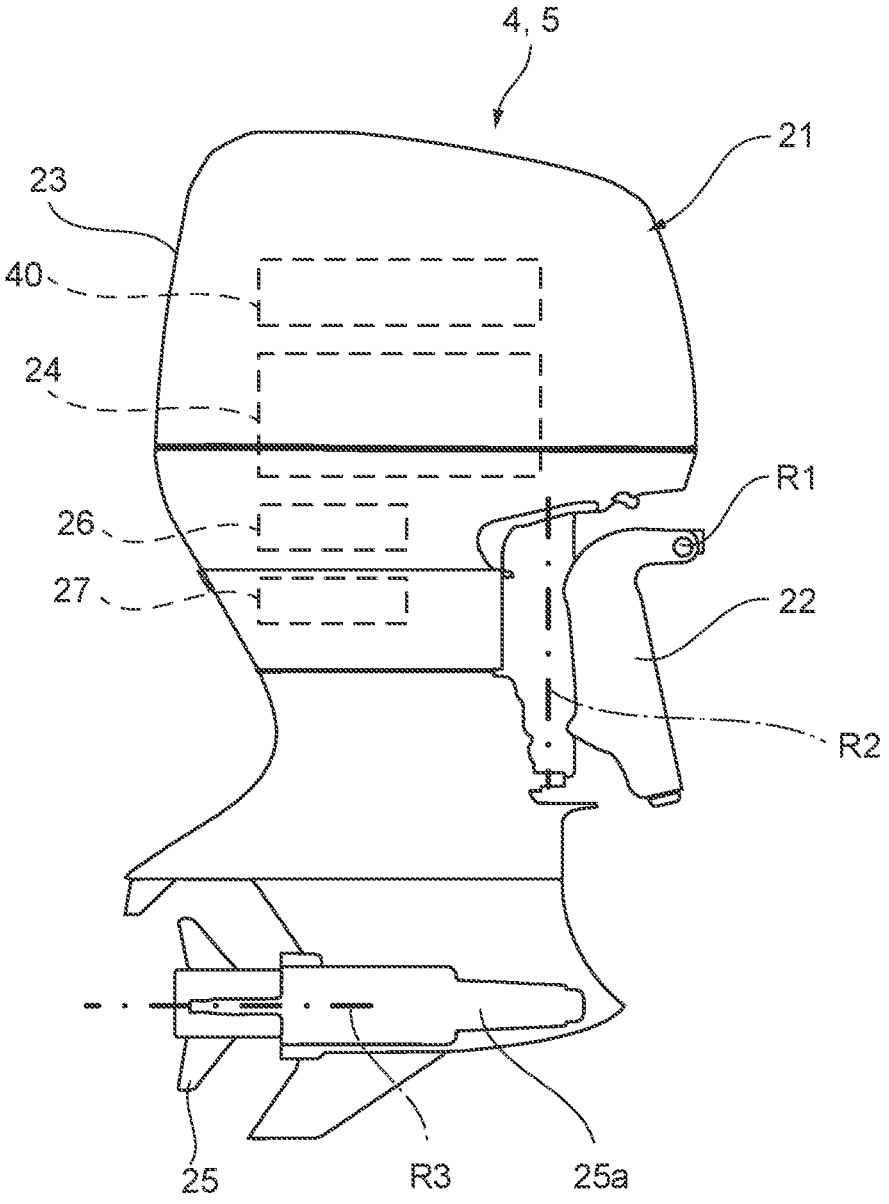
FIG. 2 is a side view of an outboard motor according to the present embodiment.

FIG. 2 is a side view of the first outboard motor 4 and the second outboard motor 5. The configuration of the first outboard motor 4 and the second outboard motor 5 are identical.

The first outboard motor 4 and the second outboard motor 5 include an outboard motor body 21 and a bracket 22. The outboard motor body 21 includes a cover member 23, a prime mover 24, a propeller 25, a steering actuator, and a trim actuator 27. The cover member 23 houses the prime mover 24. The prime mover 24 and the propeller 25 are connected by a power transmission mechanism (not illustrated), and the propeller 25 is rotated and driven by the driving force of the prime mover 24. The prime mover 24 is an engine or electric motor that drives the propeller 25.

The bracket 22 is a mounting mechanism for detachably attaching the first outboard motor 4 and the second outboard motor 5 to the stern 3. The first outboard motor 4 and the second outboard motor 5 are rotatably attached around a trim axis R1 of the bracket 22 by the trim actuator 27. By rotating the first outboard motor 4 and the second outboard motor 5 around the trim axis R1, the trim angle, which is the tilt of the first outboard motor 4 and the second outboard motor 5 in the pitching direction (trim direction) with respect to the hull 2, can be changed. The first outboard motor 4 and the second outboard motor 5 are attached by the steering actuator 26 to be rotatable around the steering axis R2 of the bracket 22. By rotating the first outboard motor 4 and the second outboard motor 5 around the steering axis R2, the steering (rudder) angle, which is the yaw direction (steering direction) tilt of the first outboard motor 4 and the second outboard motor 5 with respect to the hull 2, can be changed. Thus, by changing the trim angle and steering angle of the first outboard motor 4 and the second outboard motor 5, the attitude in the pitching direction and turning in the yaw direction of the hull 2 are controlled. The propeller 25 can rotate around the rotary axis R3 by the driving force transmitted from the prime mover 24 to the drive shaft 25*a*.

[Control Configuration of Vessel 1]

Figure 3:
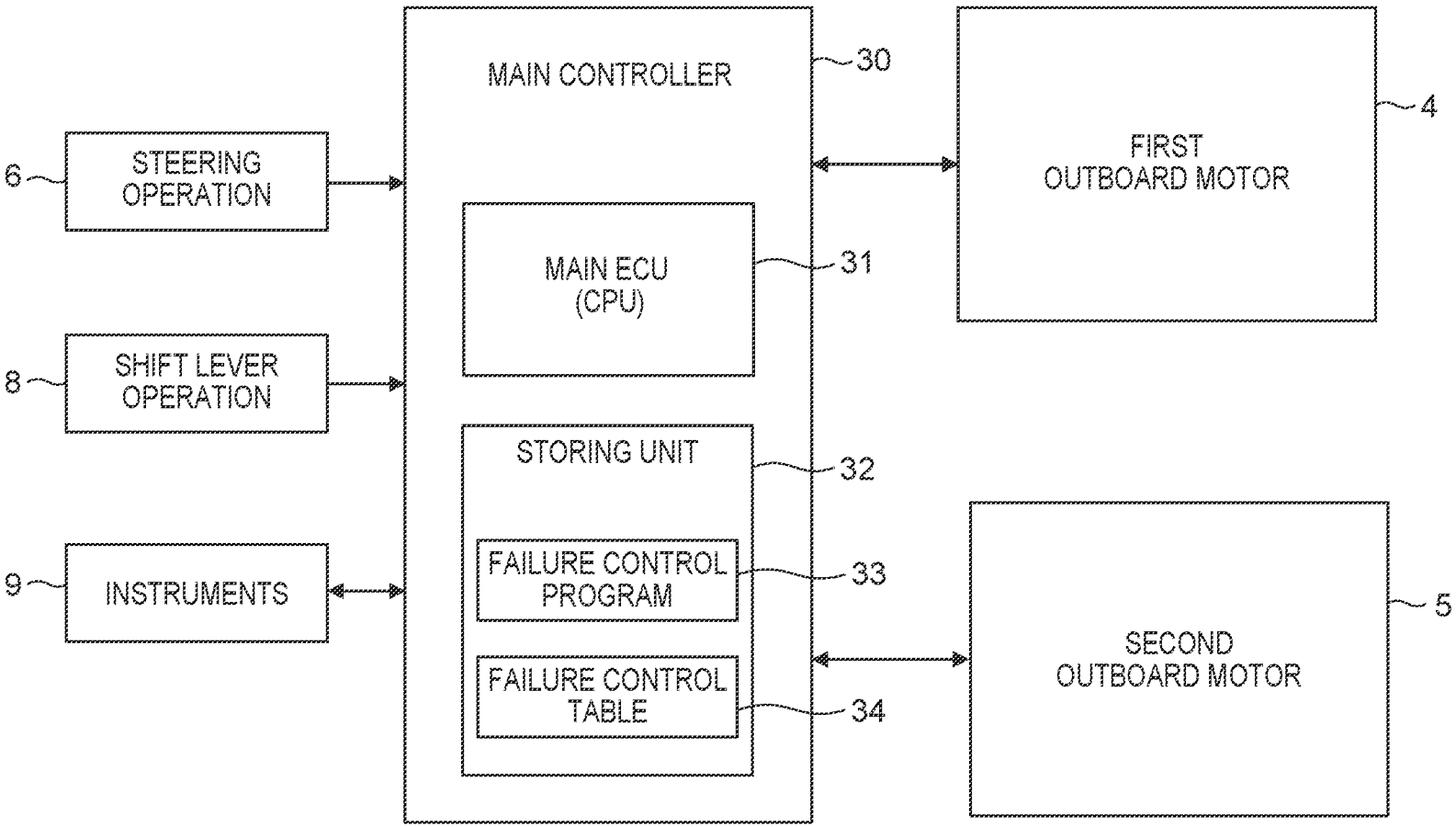
FIG. 3 is a block diagram illustrating the control configuration of a vessel according to the present embodiment.

FIG. 3 is a block diagram illustrating the control configuration of a vessel according to the present embodiment;

In the vessel 1 of the present embodiment, a main controller 30 controls the hull 2, the first outboard motor 4, the second outboard motor 5, and the instruments 9 based on the steering operation information of the steering apparatus 6 and the operation information of the shift lever 8 of the remote controller 7. The main controller 30 includes a main electronic control unit (ECU) 31 and a storing unit 32. The main ECU 31 includes a CPU and other components that control the hull 2, the first outboard motor 4, and the second outboard motor 5 by executing a control program stored in the storing unit 32. The storing unit 32 includes a memory that stores control programs and data tables executed by the main ECU 31. The control program executed by the main ECU 31 includes a failure control program described below, and the data table referenced by the main ECU 31 executing the control program include the failure control table referenced in the failure control program described below.

The main ECU 31 can control the first outboard motor 4 and the second outboard motor 5 independently.

[Control Configuration of First Outboard Motor 4 and Second Outboard Motor 5]

Figure 4:
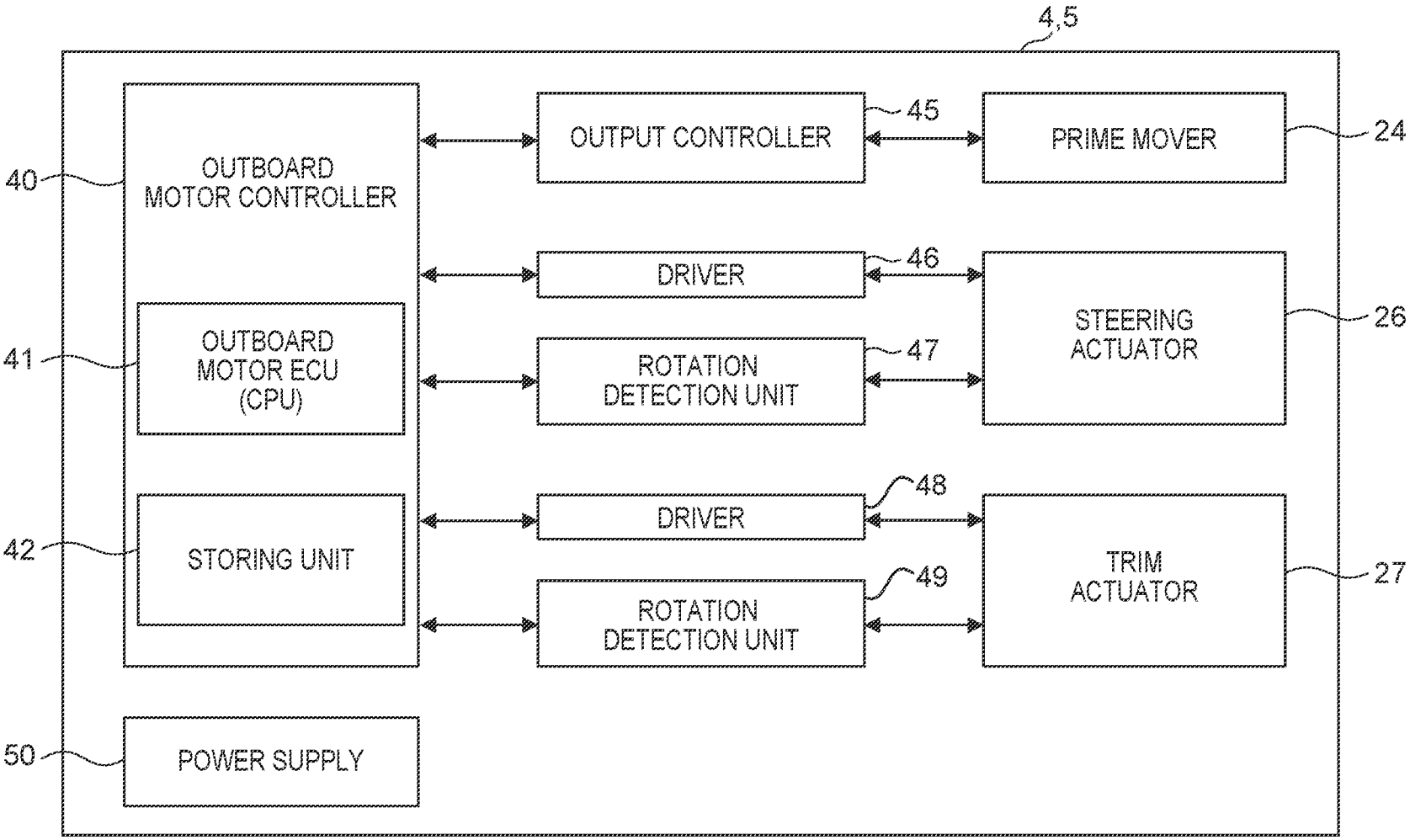
FIG. 4 is a block diagram illustrating the control configuration of an outboard motor according to the present embodiment.

FIG. 4 is a block diagram illustrating the control configuration of the first outboard motor 4 and the second outboard motor 5 according to the present embodiment. The control configuration of the first outboard motor 4 and the second outboard motor 5 are identical.

In the first outboard motor 4 and the second outboard motor 5 of the present embodiment, the outboard motor controller 40 controls the prime mover 24, the steering actuator 26, and the trim actuator 27 based on control information from the main controller 30. The outboard motor controller 40 includes an outboard motor electronic control unit (ECU) 41 and a storing unit 42. The outboard motor ECU 41 includes a CPU and other components that control the prime mover 24, the steering actuator 26, and the trim actuator 27 by executing a control program stored in the storing unit 42. The storing unit 42 includes a memory that stores control programs and data tables executed by the outboard motor ECU 41.

The prime mover 24 is an engine or electric motor. The output controller 45 controls the output of the prime mover 24. When the prime mover 24 is an engine, the output controller 45 is a motor and a driver that adjusts the throttle valve opening. When the prime mover 24 is an electric motor, the output controller 45 is a driver that adjusts the power supplied to the motor.

The steering actuator 26 is a stepper motor that rotates the bracket 22 around the steering axis R2. The driver 46 is a circuit that drives the steering actuator 26 to rotate around the steering axis R2. The rotation detector 47 is an encoder that detects the amount, angle, speed, and direction of rotation of the steering actuator 26 around the steering axis R2.

The trim actuator 27 is a stepper motor that rotates the bracket 22 around the trim axis R1. The driver 48 is a circuit that drives and rotates the trim actuator 27 around the trim axis R1. The rotation detector 49 is an encoder that detects the amount, angle, speed, and direction of rotation of the trim actuator 27 around the trim axis R1.

A power supply 50 is a battery that supplies power to the components of the first outboard motor 4 and the second outboard motor 5.

[Failure Control]

Next, the failure control of the present embodiment will be described with reference to FIGS. 5A to 5D and FIG. 6.

The failure control of the present embodiment is used when propulsion cannot be obtained due to failure of either the first outboard motor 4 or the second outboard motor 5. Hereinafter, an example of a case where the first outboard motor 4 fails and the second outboard motor 5 is non-faulty, will be described.

FIGS. 5A to 5D illustrate the failure control of the present embodiment.

Figure 5A:
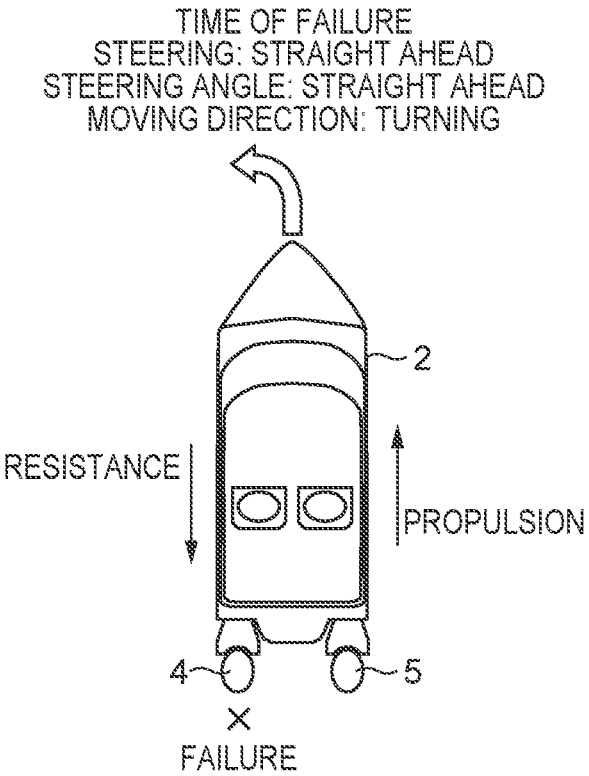
FIGS. 5A-5D are diagrams illustrating a failure control according to the present embodiment
Figure 5B:
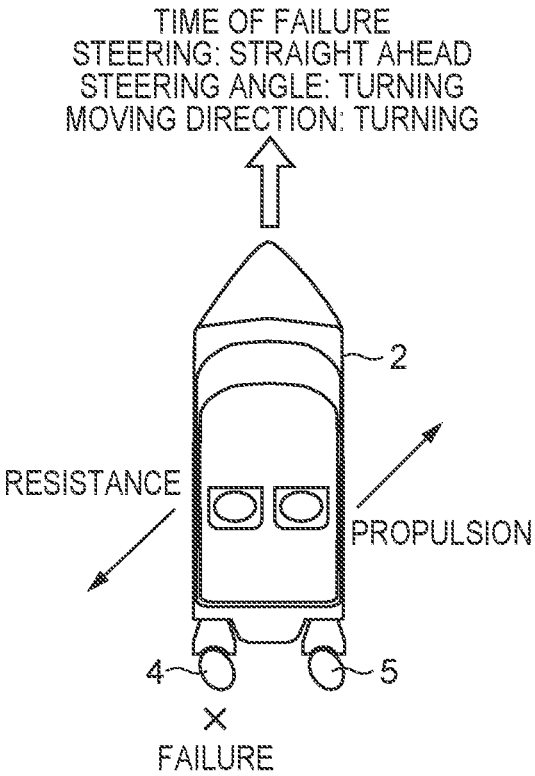

In a case where the first outboard motor 4 fails and no propulsion is obtained from the first outboard motor 4, as illustrated in FIG. 5A, if the propulsion and steering angle of the second outboard motor 5 are controlled in the same manner as in normal operation without failure, the operator may not be able to steer the vessel as intended. In this case, for example, as illustrated in FIG. 5B, when the hull 2 is to move straight ahead, a different control than normal operation is required, such as controlling the steering angle in the turning direction for both the second outboard motor 5 generating propulsion and the first outboard motor 4 generating no propulsion.

Figure 5C:
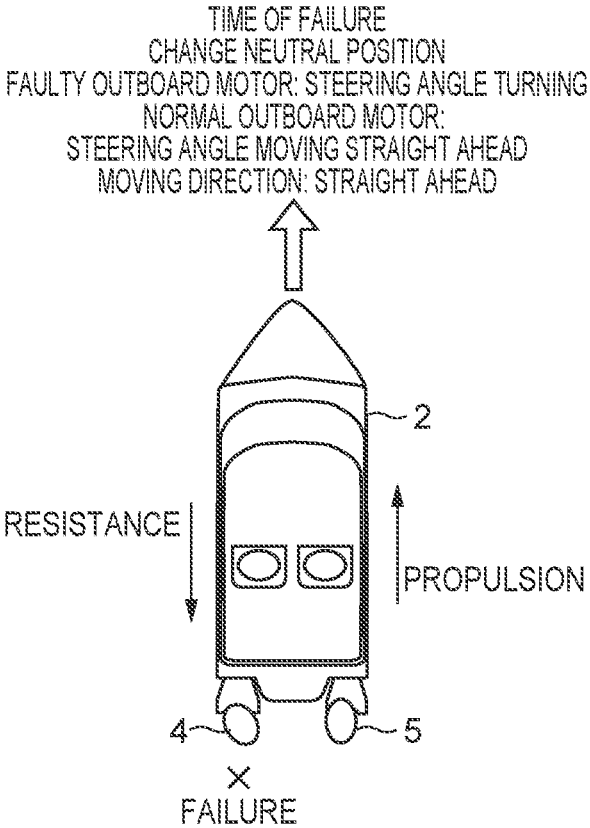
Figure 5D:
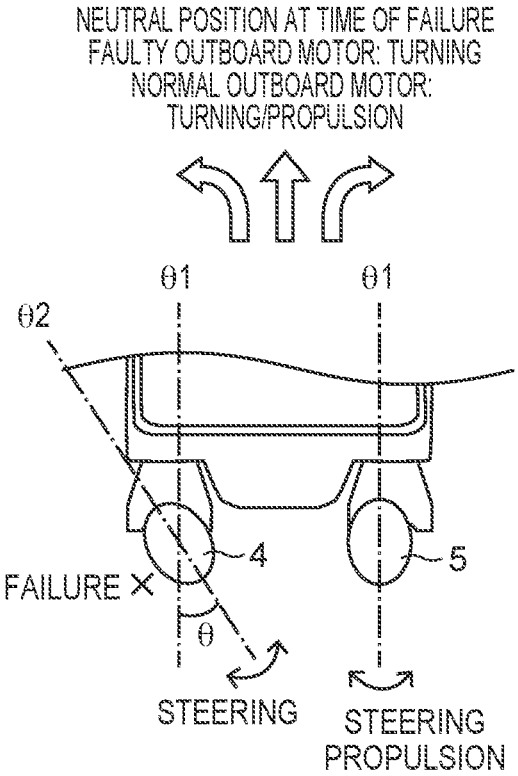

Therefore, the failure control of the present embodiment changes the moving direction and turning direction of the hull 2 in the same manner as normal operation by controlling the steering angle and propulsion of the non-faulty second outboard motor 5 and the steering angle of the faulty first outboard motor 4 as illustrated in FIGS. 5C and 5D.

In the failure control of the present embodiment, for example, the neutral position θ1 of the faulty first outboard motor 4 and/or the non-faulty second outboard motor 5 is changed so that the hull 2 moves straight ahead. The neutral position θ1 is the reference position when determining the steering angle of the outboard motor, which is normally the steering angle in the straight ahead direction (steering angle is zero). In contrast, in case of failure, for example, as illustrated in FIG. 5D, the neutral position θ1 of the non-faulty second outboard motor 5 remains unchanged in the straight ahead direction (steering angle θ is zero), and the neutral position θ1 of the faulty first outboard motor 4 is changed to the neutral position θ2 rotated by an angle θ in the direction to turn (right turn) opposite to the position of the first outboard motor 4 (port side). The steering angle of the faulty first outboard motor 4 is controlled using the changed neutral position θ2 as the reference position, and the steering angle and propulsion of the non-faulty second outboard motor 5 are controlled using the neutral position θ1 as the reference position. When the hull 2 cannot be corrected to move straight ahead only by changing the neutral position θ1 of the faulty first outboard motor 4, the neutral position θ1 of the non-faulty second outboard motor 5 may be changed. In this case, the steering angle is set such that the neutral position θ1 of the non-faulty second outboard motor 5 turns in the opposite direction (right turn) to the position of the first outboard motor 4 (port side).

The failure control of the present embodiment is realized by the failure control program 33 the failure control table 34 stored in the storing unit 32 of the main controller 30 illustrated in FIG. 2. The main ECU 31 of the main controller 30 executes the failure control program 33 stored in the storing unit 32 and also refers to the failure control table 34 to realize the failure control of the present embodiment.

In the failure control table 34, control information such as data and parameters such as the relationship between the neutral positions θ1 and θ2 before and after the change of the outboard motors, the propulsion, and the steering angle from the neutral positions θ1 and θ2 according to steering operation are registered for reference by the main ECU 31 that executes the failure control program 33. The failure control table 34 is generated in advance through failure experiments.

The main ECU 31 sets the steering angles of the first outboard motor 4 and the second outboard motor 5 based on the neutral positions θ1 and θ2 so that the hull 2 moves or turns according to the failure control program and based on the steering operation information and the operation information of the shift lever 8 of the remote controller 7.

For example, when the hull is to turn in the same direction (left turn) as the position of the first outboard motor 4 (port side), the main ECU 31 maintains the steering angle of the second outboard motor 5 at the neutral position θ1 and sets the steering angle of the first outboard motor 4 to a steering angle rotated clockwise in the figure such that the first outboard motor 4 turns in the opposite direction (left turn) from the neutral position θ2 to the position of the second outboard motor 5 (starboard side), which is closer to the neutral position θ1 before the failure. When the main ECU 31 cannot control the attitude of the hull 2 by simply setting the steering angle of the faulty first outboard motor 4, it controls the propulsion of the non-faulty second outboard motor 5.

Alternatively, when the hull is to turn in the same direction (left turn) as the position of the first outboard motor 4 (port side), the main ECU 31 maintains the steering angle of the first outboard motor 4 at the neutral position θ2 and sets the steering angle of the second outboard motor 5 to a steering angle rotated clockwise in the figure such that the second outboard motor turns in the opposite direction (left turn) from the neutral position θ1 to the position of the second outboard motor 5 (starboard side). When the main ECU 31 cannot control the attitude of the hull 2 by simply setting the steering angle of the non-faulty second outboard motor 5, it controls the propulsion of the second outboard motor 5.

When the hull is to turn in the opposite direction (right turn) to the position of the first outboard motor 4 (port side), the main ECU 31 maintains the steering angle of the second outboard motor 5 at the neutral position θ1 and sets the steering angle of the first outboard motor 4 to a steering angle rotated counterclockwise in the figure such that the first outboard motor 4 turns in the opposite direction (right turn) from the neutral position θ2 to the position of the first outboard motor 4 (port side). When the main ECU 31 cannot control the attitude of the hull 2 by simply setting the steering angle of the faulty first outboard motor 4, it controls the propulsion of the non-faulty second outboard motor 5.

Alternatively, when the hull is to turn in the opposite direction (right turn) to the position of the first outboard motor 4 (port side), the main ECU 31 maintains the steering angle of the first outboard motor 4 at the neutral position θ2 and sets the steering angle of the second outboard motor 5 to a steering angle rotated counterclockwise in the figure such that the second outboard motor 5 turns in the same direction (right turn) from the neutral position θ1 as the position of the second outboard motor 5 (starboard side). When the main ECU 31 cannot control the attitude of the hull 2 by simply setting the steering angle of the non-faulty second outboard motor 5, it controls the propulsion of the second outboard motor 5.

<Control Flow>

Figure 6:
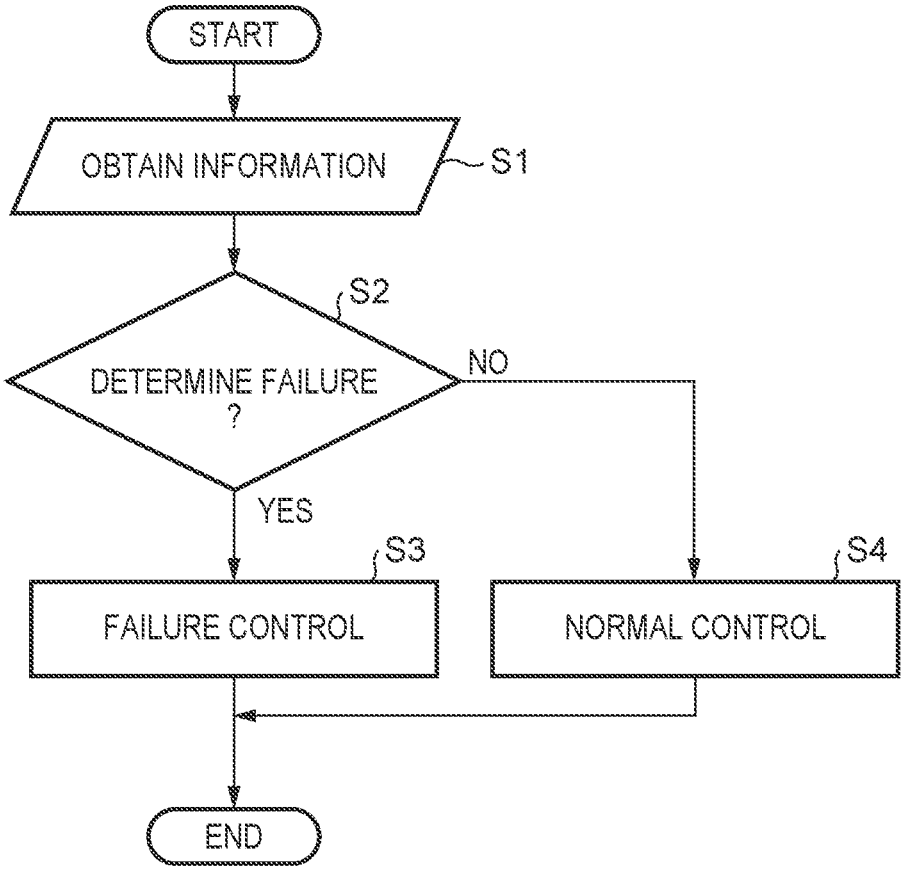
FIG. 6 is a flowchart illustrating the failure control according to the present embodiment.

FIG. 6 is a flowchart illustrating the failure control of the present embodiment.

In FIG. 6, in step S1, the main ECU 31 obtains information from the output controller 45 of the prime mover 24 and the rotation detectors 47 and 59 of the first outboard motor 4 and the second outboard motor 5.

In step S2, the main ECU 31 determines whether one of the first outboard motor 4 or the second outboard motor 5 has failed based on the information obtained in step S1. Then, when the main ECU 31 determines that either the first outboard motor 4 or the second outboard motor 5 has failed, the processing proceeds to step S3 to perform failure control, and when the main ECU 31 determines that neither the first outboard motor 4 nor the second outboard motor 5 has failed, the processing proceeds to step S4 to perform normal control.

In step S3, the main ECU 31 drives the driver 46 according to a failure control program 55 and controls the steering actuator 26 to change the neutral position of the first outboard motor 4 and the second outboard motor 5 based on the detection result of the steering angle of the steering actuator 26 by the rotation detector 47, and controls the prime mover 24, the steering actuator 26, and the trim actuator 27.

In step S4, the main ECU 31 controls the prime mover 24, the steering actuator 26, and the trim actuator 27 according to a normal control program.

The above embodiment describes a case in which one of the two outboard motors fails. However, if one outboard motor fails while two or more outboard motors are disposed on the left and right sides, with a total of at least four outboard motors attached, the steering angle of all outboard motors including the faulty outboard motor may be set according to the output balance of the non-faulty outboard motors on the left and right sides. In this case, when the control cannot be performed only by the steering angle, the propulsion of the non-faulty outboard motor may be controlled.

As described above, according to the present embodiment, even if either the first outboard motor 4 or the second outboard motor 5 fails, the operator will be able to move or turn the hull 2 in the desired direction by the same steering operation as in normal operation without failure.

In particular, when either the first outboard motor 4 or the second outboard motor 5 has failed, the operator can make the hull 2 move or turn in the desired direction simply by performing the same steering operations as in normal operation, by using the faulty outboard motor for auxiliary steering.

The main ECU 31 controls the steering angles of the first outboard motor 4 and the second outboard motor 5 using the steering angles of the first outboard motor 4 and the second outboard motor 5 at which the hull 2 moves straight ahead as the neutral positions θ1 and θ2, respectively. This allows steering control based on the corrected neutral position θ2 by correcting the neutral position θ1 of the steering angle of the faulty outboard motor so that the hull 2 moves straight ahead.

When the propulsion of the first outboard motor 4 cannot be obtained, the main ECU 31 sets the steering angle of the second outboard motor 5 to the neutral position θ1 in the straight ahead direction and the steering angle of the first outboard motor 4 to the neutral position in the direction of turning opposite to the position of the first outboard motor 4. This allows the hull 2 to move or turn in the desired direction by correcting the neutral position θ1 of the steering angle of the faulty first outboard motor 4 so that the hull 2 moves straight ahead, and controlling the steering angle of the first outboard motor 4 with respect to the corrected neutral position θ2.

When the hull 2 cannot be corrected to move straight ahead simply by changing the neutral position θ1 of the faulty first outboard motor 4, the main ECU 31 sets the neutral position θ1 of the non-faulty second outboard motor 5 at a steering angle such that it turns in the opposite direction to the position of the first outboard motor 4. This allows the hull 2 to move or turn in the desired direction by correcting the neutral position θ1 of the steering angle of the faulty first outboard motor 4 and the non-faulty second outboard motor 5 so that the hull 2 moves straight ahead, and controlling the steering angle of the first outboard motor 4 and the second outboard motor 5 with respect to the corrected neutral position θ2.

When the attitude of the hull 2 cannot be controlled simply by setting the steering angle of the faulty first outboard motor 4 and the steering angle of the non-faulty second outboard motor 5, the main ECU 31 controls the propulsion of the non-faulty second outboard motor 5. This allows the hull 2 to move or turn in the desired direction.

When at least one outboard motor fails while two or more outboard motors are disposed on the left and right sides in the width direction of the hull 2, the main ECU 31 sets the steering angle of all outboard motors including the faulty outboard motor according to the balance of the propulsion of the non-faulty outboard motors.

Furthermore, the main ECU 31 controls the propulsion of the non-faulty outboard motors in addition to the steering angle of all outboard motors, including the faulty outboard motor according to the balance of the propulsion of the non-faulty outboard motors.

This allows the operator to move or turn the hull 2 in the desired direction simply by performing the same steering operation as under normal conditions, even if at least one outboard motor fails while two or more outboard motors are disposed on the left and right sides of the hull 2 in the width direction.

The present invention is not limited to the above embodiments, and thus various modifications and changes may be made within the scope of the gist of the present invention. For example, the present embodiment includes two outboard motors, but the number of outboard motors is not limited to two and may be three or more.

In the present invention, a computer program corresponding to the control of outboard motors of the above described embodiment or a storage medium containing the computer program may be supplied to a computer controlling the hull 2 and the outboard motors 4, 5, so that the computer reads and executes the program code stored in the storage medium.

What is claimed is:

1. A control apparatus for a plurality of outboard motors spaced apart at predetermined intervals in a width direction of a hull, comprising:

a first steering unit that adjusts a steering angle of the first outboard motor;

a second steering unit that adjusts a steering angle of the second outboard motor; and a control unit that controls the first steering unit and the second steering unit such that the hull moves or turns in a direction in accordance with a steering instruction of an operator by controlling the steering angle of all outboard motors, including a faulty outboard motor that does not output a propulsion and controlling the propulsion of a non-faulty outboard motor according to a balance of the propulsion of the non-faulty outboard motors when the faulty outboard motor cannot output the propulsion and is steerable in a tilted-down state.

2. The apparatus according to claim 1, wherein the control unit controls the first steering unit and the second steering unit using the steering angle of the first outboard motor and the steering angle of the second outboard motor, at which the hull moves straight ahead, as neutral positions (θ1, θ2).

3. The apparatus according to claim 2, wherein when the first outboard motor is failed, the control unit sets the neutral position (θ1) of the steering angle of the second outboard motor to the straight ahead direction, and sets the neutral position (θ2) of the steering angle of the first outboard motor to the direction of turning opposite to the position of the first outboard motor.

4. The apparatus according to claim 3, wherein when the hull cannot be corrected to move straight ahead simply by changing the neutral position (θ1) of the first outboard motor, the control unit sets the neutral position (θ1) of the second outboard motor at a steering angle such that the second outboard motor turns in the opposite direction to the position of the first outboard motor.

5. The apparatus according to claim 3, wherein the control unit controls the propulsion of the second outboard motor, and controls the propulsion of the second outboard motor when an attitude of the hull cannot be controlled simply by setting the steering angle of the first outboard motor and the steering angle of the second outboard motor.

6. The apparatus according to claim 1, wherein when at least one outboard motor fails while two or more outboard motors are disposed on the left and right sides in the width direction of the hull, the control unit sets the steering angle of all outboard motors including the faulty outboard motor according to the balance of propulsion of the non-faulty outboard motors.

7. The apparatus according to claim 6, wherein the control unit controls the propulsion of the non-faulty outboard motors in addition to the steering angle of all outboard motors including the at least one faulty outboard motor, according to the balance of propulsion of the non-faulty outboard motors.

8. A method of controlling a plurality of outboard motors spaced apart at predetermined intervals in a width direction of a hull, wherein the plurality of outboard motors include a first outboard motor and a second outboard motor, the method comprising:

controlling a first steering unit that adjusts the steering angle of the first outboard motor and a second steering unit that adjusts the steering angle of the second outboard motor such that the hull moves or turns in a direction in accordance with a steering instruction of an operator by controlling the steering angle of all outboard motors, including a faulty outboard motor that does not output a propulsion and controlling the propulsion of a non-faulty outboard motor according to a balance of the propulsion of the non-faulty outboard motor when the faulty outboard motor cannot output the propulsion and is steerable in a tilted-down state.

* * * * *